US010642204B2

(12) United States Patent
Sakai et al.

(10) Patent No.: US 10,642,204 B2
(45) Date of Patent: May 5, 2020

(54) IMAGE FORMING APPARATUS

(71) Applicant: KONICA MINOLTA, INC., Chiyoda-ku, Tokyo (JP)

(72) Inventors: Katsuhide Sakai, Toyokawa (JP); Yasuhiro Ishihara, Toyohashi (JP); Satoshi Chikazawa, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/259,720

(22) Filed: Jan. 28, 2019

(65) Prior Publication Data

US 2019/0265624 A1 Aug. 29, 2019

(30) Foreign Application Priority Data

Feb. 27, 2018 (JP) ..... 2018-033241

(51) Int. Cl.
*G03G 15/00* (2006.01)

(52) U.S. Cl.
CPC ..... *G03G 15/5008* (2013.01); *G03G 15/5045* (2013.01); *G03G 15/55* (2013.01); *G03G 2215/00632* (2013.01)

(58) Field of Classification Search
CPC . G03G 15/5008; G03G 15/55; G03G 15/5045
See application file for complete search history.

(56) References Cited

U.S. PATENT DOCUMENTS 5,220,831 A * 6/1993 Lee ..... G01P 1/006 73/497
2007/0127948 A1* 6/2007 Akiyama ..... G03G 15/5008 399/167
2007/0212083 A1* 9/2007 Ishikuro ..... G03G 15/2014 399/44
2015/0145454 A1* 5/2015 Kameyama ..... H02P 6/186 318/400.32
2018/0309400 A1* 10/2018 Kitamura ..... G03G 15/6558
2019/0033771 A1* 1/2019 Sakai ..... G03G 15/80

FOREIGN PATENT DOCUMENTS

JP 57070550 A * 5/1982 ..... G03G 15/5008
JP 07333245 A * 12/1995
JP H09138531 A 5/1997
JP 2007062250 A 3/2007
JP 2011102853 A 5/2011
JP 2014002233 A 1/2014

OTHER PUBLICATIONS

Machine translation of Tone et al., JP 2014-002233.*

* cited by examiner

*Primary Examiner* — Sevan A Aydin
(74) *Attorney, Agent, or Firm* — Holtz, Holtz & Volek PC

(57) ABSTRACT

An image forming apparatus that forms an image on a sheet includes: a rotating body that forms the image; a motor that rotationally drives the rotating body; a current measurer that measures a motor current flowing through a current supply path including a winding of the motor at a measurement timing that is a timing after the motor is started; a torque acquisitor that acquires a torque value of the motor, based on a measured value of the motor current; and a corrector that performs correction to cancel a current change amount based on a characteristic change depending on a temperature state of the motor at the measurement timing, in acquisition of the torque value by the torque acquisitor.

10 Claims, 13 Drawing Sheets

FIG. 8

70c

| DEVIATION AMOUNT $\Delta\omega$ | CURRENT CORRECTION AMOUNT $\Delta Im$ |
|---|---|
| 5 | --- |
| 4 | 0.04 |
| 3 | |
| 2 | 0.02 |
| 1 | |
| 0 | 0 (NO CORRECTION) |
| −1 | −0.02 |
| −2 | |
| −3 | −0.04 |
| −4 | |
| −5 | --- |

FIG. 14

70d

| DEVIATION AMOUNT $\Delta\theta$ | CURRENT CORRECTION AMOUNT $\Delta Im$ |
|---|---|
| 5 | --- |
| 4 | 0.04 |
| 3 | |
| 2 | 0.02 |
| 1 | |
| 0 | 0 (NO CORRECTION) |
| −1 | −0.02 |
| −2 | |
| −3 | −0.04 |
| −4 | |
| −5 | --- |

IMAGE FORMING APPARATUS

The entire disclosure of Japanese patent Application No. 2018-033241, filed on Feb. 27, 2018, is incorporated herein by reference in its entirety.

BACKGROUND

Technological Field

The present invention relates to an image forming apparatus.

Description of the Related Art

An image forming apparatus such as a printer, copying machine, or multifunction machine includes various rotating bodies such as rollers for conveying sheets, and motors that drive these rotating bodies. In this type of image forming apparatus, it is known that a state of a rotating body is determined by measuring torque generated by a motor.

JP 2014-2233 A discloses that, in an electrophotographic image forming apparatus, an image is formed plural times by changing temperature of a photoconductor, and torque of a motor that drives the photoconductor is measured by a torque sensor at that time, and a degradation state of the photoconductor is determined on the basis of a change in torque.

JP 2011-102853 A discloses that, in a multifunction machine including an automatic document conveying apparatus, torque of a motor that drives a document conveying roller is detected on the basis of a motor current supplied to the motor, and on the basis of the torque detected, it is determined whether or not a loose-leaf document is being conveyed.

On the other hand, as a prior art for suppressing temperature rise of a motor accompanying rotational driving, there are techniques described in JP 2007-62250 A and JP H9-138531 A. JP 2007-62250 A discloses that, to prevent overheating of a motor during continuous printing, temperature of the motor is predicted on the basis of the number of fed sheets, and a conveying speed of the sheet is changed depending on the predicted temperature. JP 2011-102853 A discloses that, a motor is provided with a temperature sensor, and a rotational speed of the motor is lowered when temperature detected by the temperature sensor is equal to or higher than a threshold value.

When the torque sensor is used for measurement of the torque as in the technique of the above-described JP 2014-2233 A, it is necessary to secure a space for arranging the torque sensor, so that problems occur that downsizing of the image forming apparatus is difficult and cost of components is increased.

Such problems can be solved by measuring the motor current as torque as in the technique of JP 2011-102853 A.

However, since the torque of the motor depends on the temperature, there has been a problem that an error occurs in the measurement of the torque depending on the temperature at the time of measurement, so that the state of the rotating body may be erroneously determined. The techniques of JP 2007-62250 A and JP H9-138531 A prevent excessive temperature rise of the motor but do not keep the temperature constant, so that this problem cannot be solved.

SUMMARY

The present invention has been made in view of the above-described problems, and it is an object to provide an image forming apparatus capable of accurately determining a state of a rotating body driven by a motor more than before without using a torque sensor.

To achieve the abovementioned object, according to an aspect of the present invention, an image forming apparatus that forms an image on a sheet, reflecting one aspect of the present invention comprises: a rotating body that forms the image; a motor that rotationally drives the rotating body; a current measurer that measures a motor current flowing through a current supply path including a winding of the motor at a measurement timing that is a timing after the motor is started; a torque acquisitor that acquires a torque value of the motor, based on a measured value of the motor current; and a corrector that performs correction to cancel a current change amount based on a characteristic change depending on a temperature state of the motor at the measurement timing, in acquisition of the torque value by the torque acquisitor.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 8 is a diagram illustrating another example of the correction information;

FIG. 14 is a diagram illustrating another example of the correction information.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
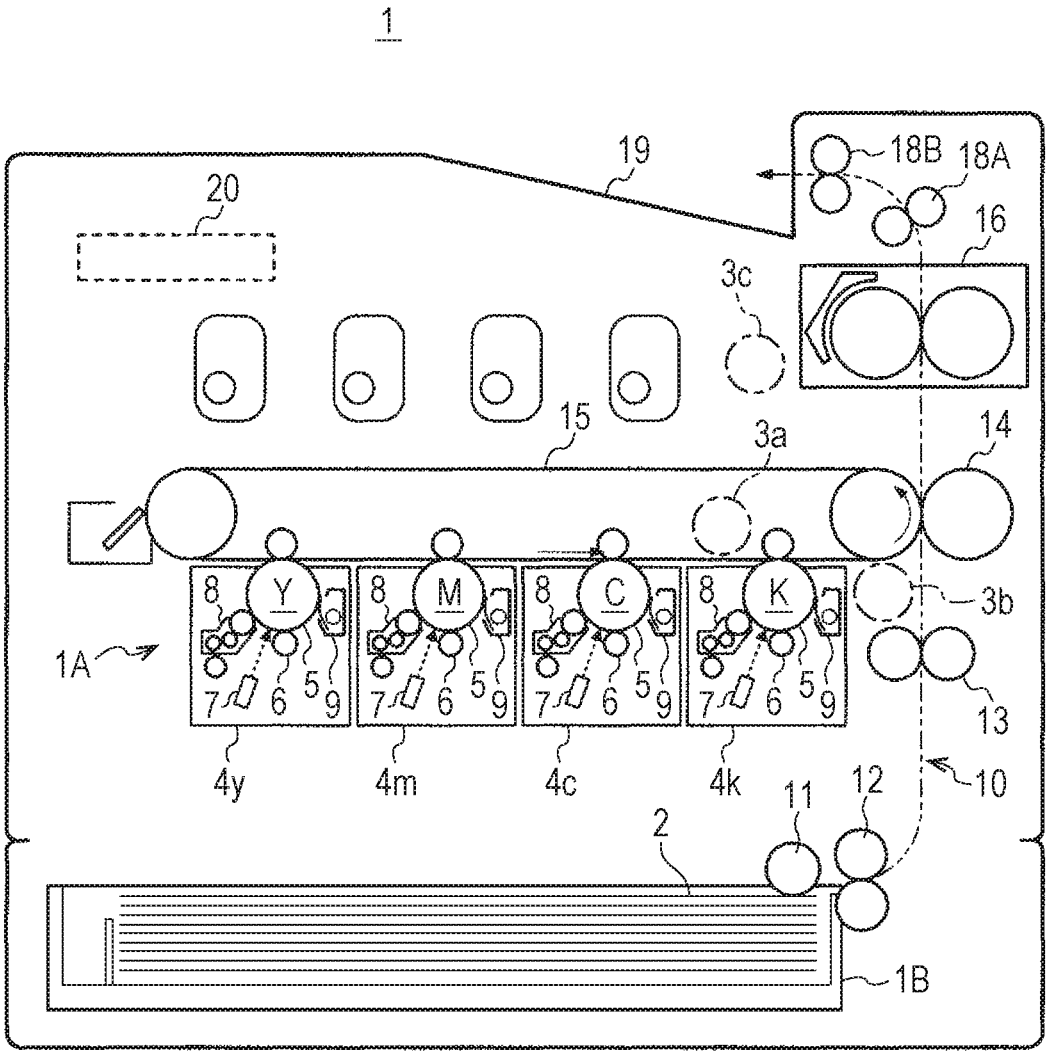
FIG. 1 is a diagram illustrating a schematic configuration of an image forming apparatus according to an embodiment of the present invention.
Figure 2:
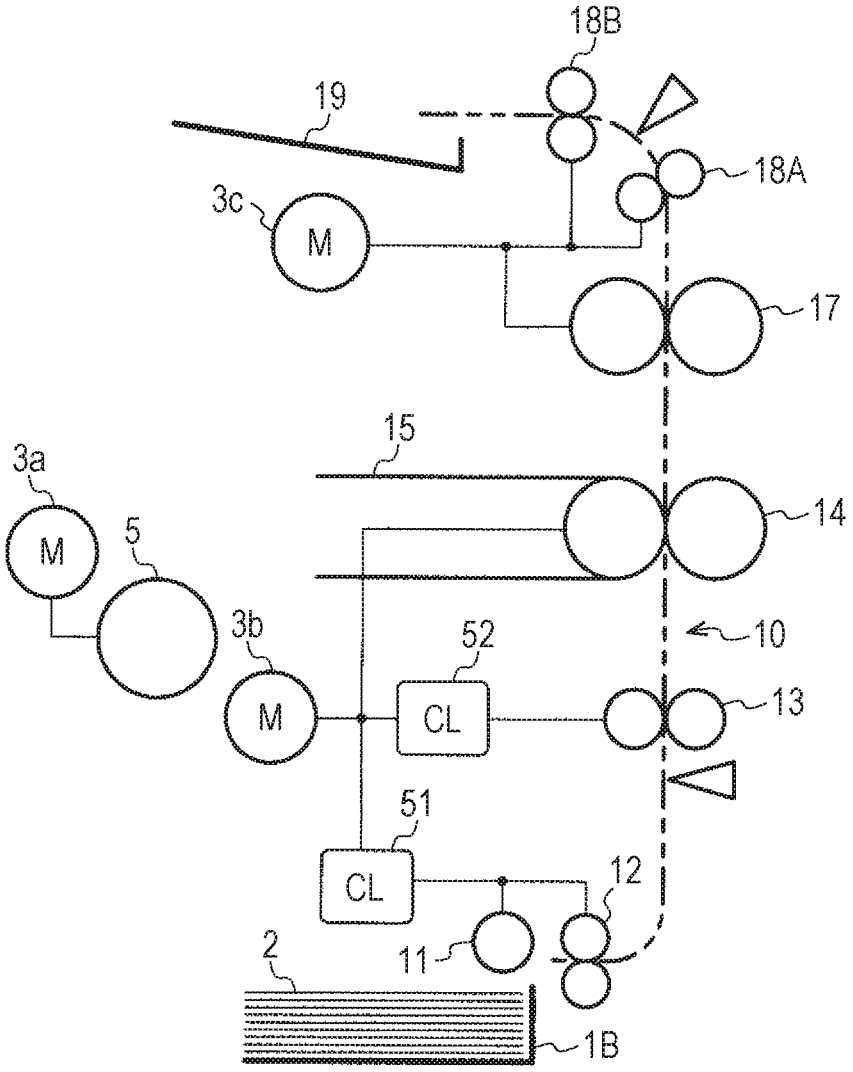
FIG. 2 is a diagram illustrating a driving target of each of a plurality of motors.

FIG. 1 illustrates a schematic configuration of an image forming apparatus 1 according to an embodiment of the present invention, and FIG. 2 illustrates a driving target of each of a plurality of motors 3*a*, 3*b*, and 3*c*.

In FIG. 1, the image forming apparatus 1 is a color printer including an electrophotographic printer engine 1A. The image forming apparatus 1 forms a color or monochrome image depending on a job input from an external host apparatus via a network. The image forming apparatus 1 includes a control circuit 20 that controls operation of the image forming apparatus 1. The control circuit 20 includes a processor that executes a control program and peripheral devices (ROM, RAM, and the like) of the processor.

The printer engine 1A includes four imaging stations 4*y*, 4*m*, 4*c* and 4*k* arranged in the horizontal direction. Each of the imaging stations 4*y* to 4*k* includes a photoconductor 5 having a cylindrical shape, a charging roller 6, a print head 7, a developing device 8, a cleaner 9 of a blade-type, and the like.

In a color printing mode, the four imaging stations 4*y* to 4*k* form toner images of four colors of yellow (Y), magenta (M), cyan (C), and black (K), respectively in parallel. The four color toner images are primarily transferred sequentially to an intermediate transfer belt 15 being rotated. First, the toner image of Y is transferred, and the toner image of M, the toner image of C, and the toner image of K are sequentially transferred to overlap with the toner image of Y.

When the toner image primarily transferred faces a secondary transfer roller 14, the toner image is secondarily transferred to a sheet (recording sheet) 2 taken out and conveyed from a storage cassette 1B below. After the secondary transfer, the toner image is fed to a sheet ejection tray 19 above through the inside of a fixing device 16. When passing through the fixing device 16, the toner image is fixed to the sheet 2 by heating and pressing.

Referring to FIG. 2, in a conveying path 10 that is a path of the sheet 2 inside the image forming apparatus 1, a pickup roller 11, a sheet feeding roller 12, a registration roller 13, the secondary transfer roller 14, a fixing roller 17, and sheet ejection rollers 18A and 18B are arranged in order from the upstream side. By rotation of these rollers, the sheet 2 is conveyed.

The image forming apparatus 1 includes the plurality of motors 3*a*, 3*b*, and 3*c* that are rotational driving sources. The motor 3*a* is mainly used as a photoconductor motor that drives the photoconductor 5 of the imaging station 4*k*. The motor 3*b* is a driving source common to the pickup roller 11, the sheet feeding roller 12, the registration roller 13, the secondary transfer roller 14, and the intermediate transfer belt 15. The motor 3*c* is a driving source common to the fixing roller 17 and the sheet ejection rollers 18A and 18B.

Rotational driving force of the motor 3*b* is transmitted to the pickup roller 11 and the sheet feeding roller 12 via a clutch 51, and to the registration roller 13 via a clutch 52. By turning on and off the clutches 51 and 52, control of rotation/stop of these rollers is performed independently of drive control of the secondary transfer roller 14.

Hereinafter, these motors 3*a* to 3*c* are sometimes referred to as "motor 3" without distinction.

The image forming apparatus 1 includes a plurality of motors besides the motors 3*a* to 3*c*. For example, there are a development motor that drives a roller in the developing device 8 of each of the imaging stations 4*y* to 4*k*, and a toner replenishing motor that drives a mechanism that replenishes toner from a toner bottle to the developing device 8.

The motor 3 is a DC brushless motor, that is, a permanent magnet synchronous motor (PMSM) in which a rotor using a permanent magnet rotates. A stator of the motor 3 includes U-phase, V-phase, and W-phase cores arranged at intervals of an electrical angle of 120°, and three windings (coils) connected together, for example, by Y-connection. Three-phase AC currents of U-phase, V-phase, and W-phase are caused to flow through the windings, and the cores are excited in order, whereby a rotating magnetic field is generated. The rotor rotates in synchronization with the rotating magnetic field.

The number of magnetic poles of the rotor may be 2, 4, 6, 8, 10 or more. The rotor may be an outer type or an inner type. In addition, the number of slots of the stator may be 3, 6, 9 or more.

In any case, to the motor 3, vector control is performed that determines a direction and magnitude of magnetic flux of the rotating magnetic field by using a control model based on a d-q coordinate system. In the vector control of the motor 3, the control is simplified by converting the AC currents of three phases flowing through the windings of the motor 3 into DC currents flowing through the windings of two phases rotating in synchronization with the rotor.

The image forming apparatus 1 has a function of measuring (detecting) torque generated by the motor 3 and determining states of various rotating bodies that are driving targets of the motor 3. The state of the rotating body includes a state of aging such as wear, alteration, or dirt, and a contact state with another member, such as sticking or wrapping of a sheet, curling of a blade for cleaning, or the like.

Hereinafter, the configuration and operation of the image forming apparatus 1 will be described focusing on this function.

Figure 3:
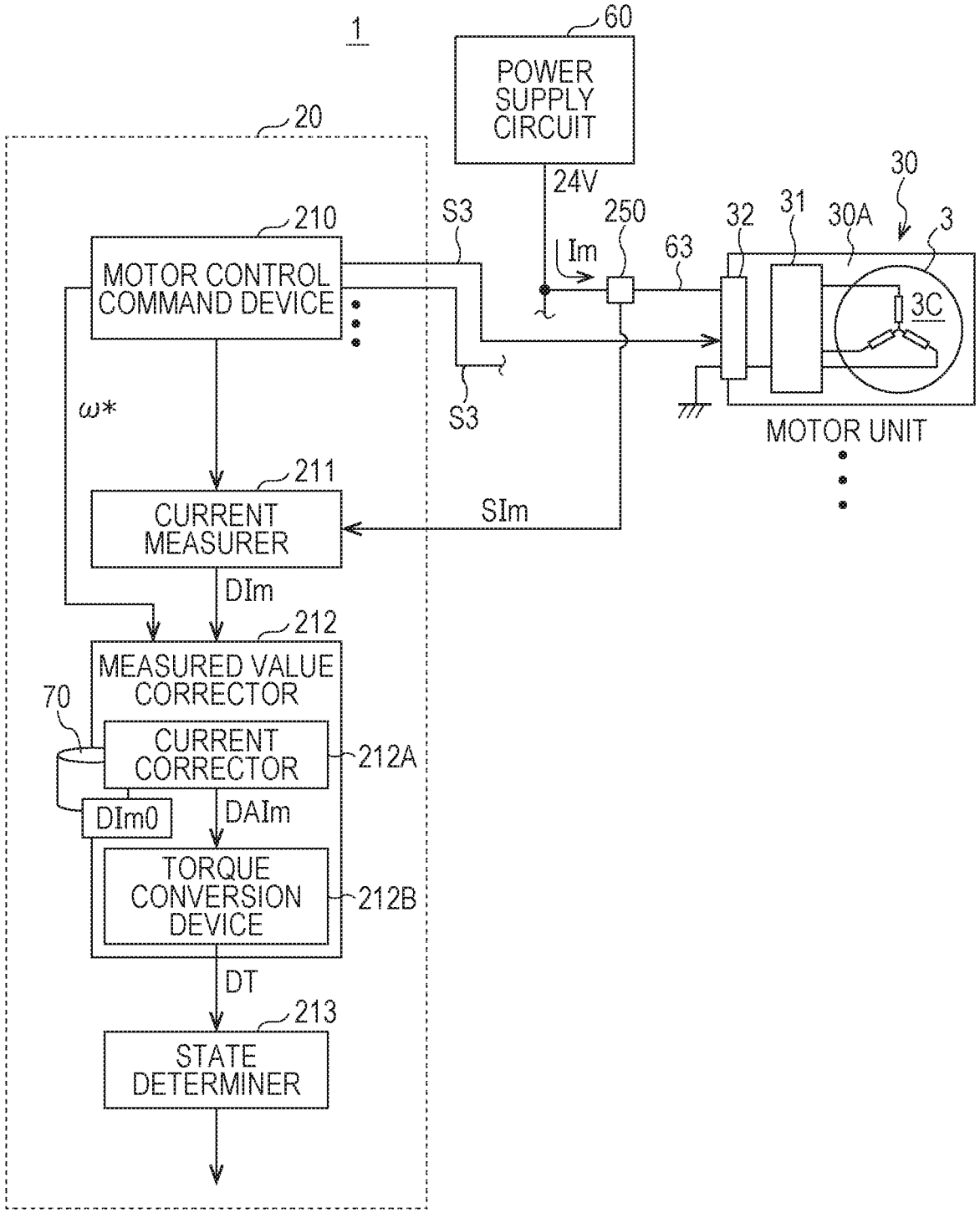
FIG. 3 is a diagram illustrating an example of implementation of a motor and a functional configuration of a main part of a control circuit.

FIG. 3 illustrates an example of implementation of the motor 3 and a functional configuration of a main part of the control circuit 20.

As the motor 3, a motor unit 30 can be used that is integrated with an electric circuit 31 for driving the motor 3 and is commercially available. In the motor unit 30, supply of driving power to the motor 3 and input of a control signal are performed via a connector 32 fixed to a circuit board 30A including the electric circuit 31. The electric circuit 31 includes an inverter that drives the motor 3, an integrated circuit component for the vector control, and the like.

To the motor unit 30, a drive current Im is supplied from a power supply circuit 60 that outputs power of a voltage (for example, 24 volts) for driving. The drive current Im is an example of a motor current flowing through a current supply path 63 including the inverter in the electric circuit 31 and a winding group 3C in the motor 3.

To the motor unit 30, a control signal S3 indicating commands such as start, stop, a target speed, and the like is input from the control circuit 20. The electric circuit 31 controls driving of the motor 3 by the inverter in accordance with a command by the control signal S3.

The control circuit 20 includes a motor control command device 210, a current measurer 211, a measured value corrector 212, and a state determiner 213. Functions of these devices are implemented by a hardware configuration of the control circuit 20, the control program being executed by a CPU, or a combination thereof.

The motor control command device 210 gives the control signal S3 to each of a plurality of the motor units 30. The rotating bodies driven by the motors 3*a* to 3*c* need to rotate at a constant speed in image formation. Specifically, the photoconductor 5 needs to rotate at a constant speed at least from the start of formation of an electrostatic latent image to the end of primary transfer of a toner image, and the intermediate transfer belt 15 needs to rotate at a constant speed at least from the start of the first primary transfer to the end of secondary transfer. In addition, the fixing roller 17 needs to rotate at a constant speed at least in a period during which the sheet 2 passes through the fixing device 16.

For this reason, the motor control command device 210 gives a command of starting of the motor 3 at an appropriate time so that rotation is stabilized by a timing at which the motor 3 should be rotated at a constant speed. An operation pattern applied to the motor 3 is basically an acceleration/deceleration pattern that performs so-called trapezoidal driving. That is, driving is started from a stopped state and accelerated to a target speed, and maintained at the target speed for a predetermined time, and then decelerated and stopped.

However, the target speed is switched depending on a process speed. The process speed is an image forming condition that defines a rotational speed of the photoconductor, a conveying speed of the sheet 2, and the like. For example, when a thick sheet is used as the sheet 2, the process speed is made lower than that in a case where a regular sheet is used. That is, a rotational speed of the motor 3 is lowered. Thus, time for the sheet 2 to pass through the fixing device 16 becomes longer, so that the sheet 2 can be sufficiently heated to improve the fixing property of a toner image.

The current measurer 211 measures the drive current Im flowing from the power supply circuit 60 to the motor unit 30 at a predetermined measurement timing that is a timing after the motor 3 is started. A current detector 250 that detects the drive current Im is provided between the power supply circuit 60 and the motor unit 30 in the current supply path 63 through which the drive current Im flows, and a detection signal SIm by the current detector 250 is input to the current measurer 211. The current measurer 211 quantizes the detection signal SIm and outputs the signal quantized as a measured value DIm of the motor current.

The measured value corrector 212 corrects the measured value DIm to cancel a current change amount based on a characteristic change depending on a temperature state of the motor 3 at the measurement timing. Note that, when the motor 3 is driven, temperature rise occurs, and a temperature rise state at this time is an example of the "temperature state" in the present invention. Correction by the measured value corrector 212 will be described later in detail.

The measured value corrector 212 is provided with a current corrector 212A and a torque conversion device 212B. The current corrector 212A corrects the measured value DIm from the current measurer 211 on the basis of correction information 70. The torque conversion device 212B converts a measured value DAIm corrected by the current corrector 212A into a torque value DT and acquires the torque value DT. That is, the torque conversion device 212B converts the motor current into the torque.

The measured value corrector 212 of the present embodiment converts the corrected measured value DAIm into the torque value DT, but conversely, the measured value corrector 212 may be configured to perform correction to the torque value depending on the temperature rise state, after converting the measured value DIm from the current measurer 211 into the torque value.

The state determiner 213 determines the state of the rotating body driven by the motor 3 on the basis of the torque value DT from the measured value corrector 212. Determination based on the torque value DT is equivalent to determination based on the measured value DAIm.

Figure 4A:
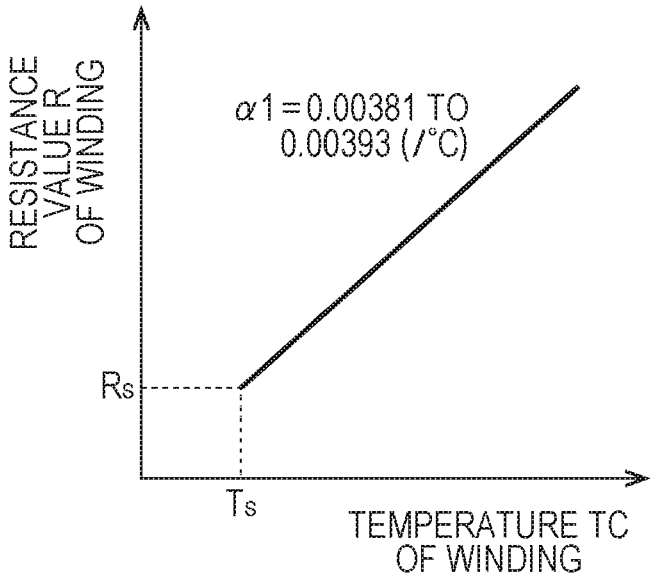
FIGS. 4A and 4B are diagrams illustrating temperature dependence of a resistance value of a winding and a trend of a temperature change of the winding after starting, respectively.
Figure 4B:
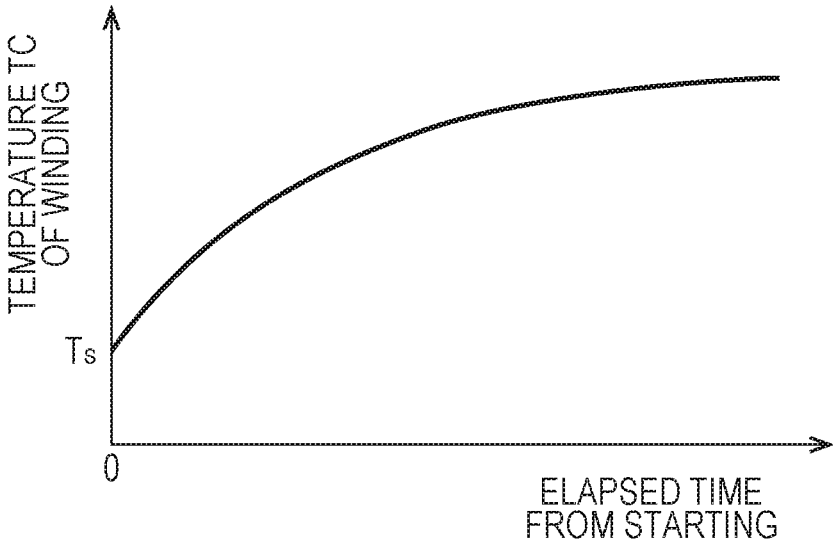

FIGS. 4A and 4B illustrate temperature dependence of a resistance value R of the winding and a trend of a temperature change of the winding after starting, respectively.

As illustrated in FIG. 4A, the resistance value R of the winding of the motor 3 increases as a temperature TC of the winding increases. The resistance value R is expressed by the following equation.

$$R=Rs[1+\alpha 1(TC-Ts)]$$

Rs: Resistance value at reference temperature

Ts: Reference temperature

TC: Temperature of winding $\alpha 1$: Temperature coefficient

In addition, as illustrated in FIG. 4B, when the motor 3 is rotated from a state in which the whole of the motor 3 is at the reference temperature Ts (for example, 20° C.), the temperature TC of the winding increases as an elapsed time from the starting of the motor 3 increases, and the temperature rise is eventually saturated. That is, the resistance value R of the winding gradually increases from the starting until the temperature rise of the winding is saturated.

When the resistance value R increases, the current flowing through the winding decreases, so that the torque of the motor 3 decreases and the rotational speed decreases. The vector control therefore increases a voltage applied to the winding and increases the drive current Im. Thus, the decrease of the torque is compensated, and the rotational speed is kept at a constant target speed.

As a result of such constant speed rotation control, even when a load of the motor 3 is constant and the torque of the motor 3 is not different from that before the temperature rise of the winding, the drive current Im is larger than before the temperature rise. There is therefore a possibility that an error occurs in the determination if it is assumed that the state of the rotating body is determined by using the measured value DIm of the drive current Im as it is as the measured value of the torque.

In the image forming apparatus 1 of the present embodiment, the measured value DIm is therefore corrected by the measured value corrector 212.

Due to heat generation of the winding group 3C, temperature rise of the permanent magnet also occurs inside the motor 3. When the temperature rise of the permanent magnet occurs, the magnetic flux linkage decreases and the torque decreases. That is, when the temperature rise of the permanent magnet occurs, the drive current Im increases with the vector control that rotates the motor 3 at a constant speed, similarly to a case where the temperature rise of the winding occurs. The measured value corrector 212 corrects the measured value DIm to reduce influence of the characteristic change due to a change of the temperature state such as the temperature rise, such as the resistance value of the winding and the magnetic flux of the permanent magnet.

Figure 5:
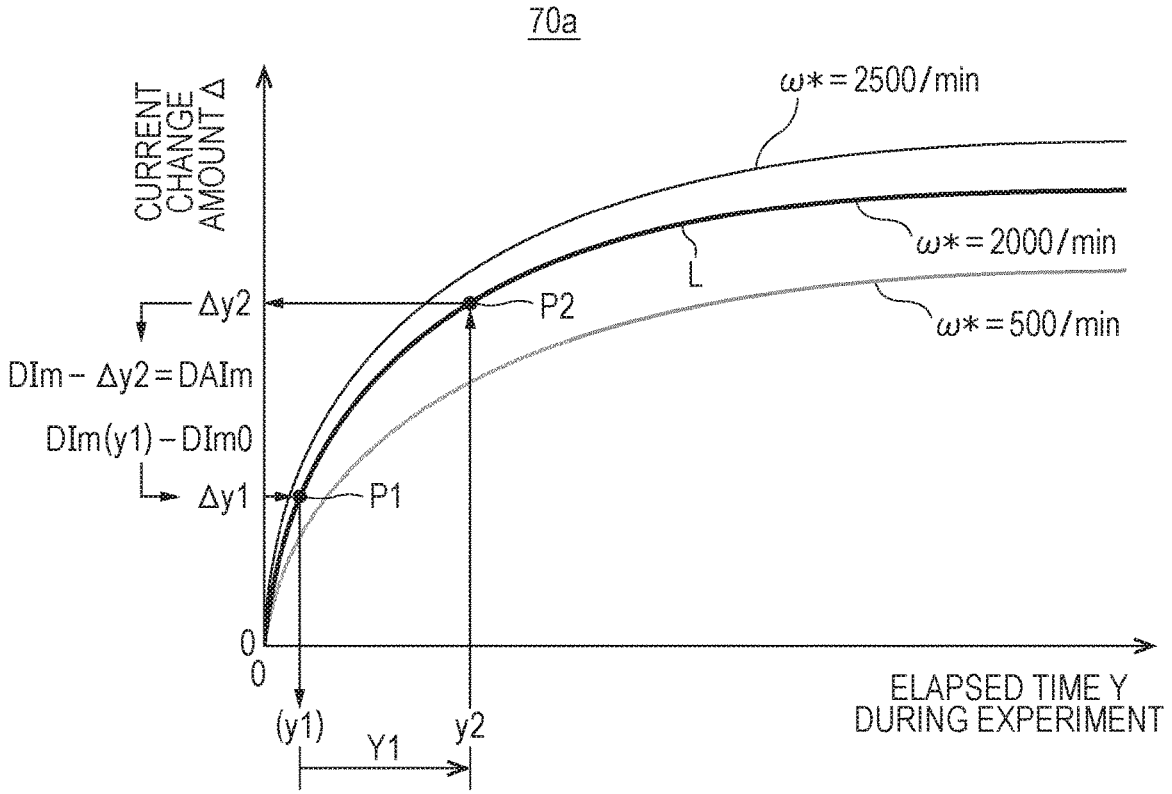
FIG. 5 is a diagram illustrating an example of correction information.

FIG. 5 illustrates an example of the correction information 70. Correction information 70*a* illustrated in FIG. 5 is data indicating a relationship between a current change amount Δ and an elapsed time Y during an experiment that is the elapsed time from the starting in a case where the motor 3 is started in a state in which the entire motor 3 is at the reference temperature Ts. The current change amount Δ is a difference between the measured value DIm of the drive current Im of when the elapsed time Y during the experiment is 0 and the measured value DIm of when the elapsed time Y during the experiment is other than 0.

The correction information 70*a* is obtained by an experiment in which a drive current Im is measured by applying a predetermined load (for example, 100 mNm) to the motor 3 using an experimental machine having a configuration in which a use condition is similar to that of the motor 3 of the image forming apparatus 1, and indicates the relationship between the current change amount Δ and the elapsed time Y during the experiment for each of a plurality of operation conditions each having a different target speed ω*. FIG. 5 illustrates relationships for respective cases where the target speeds ω* are 500/min (500 rpm), 2000/min (2000 rpm), and 2500/min (2500 rpm).

FIG. 5 illustrates data of when the motor 3 is started in a state in which the temperature of the motor 3 is the reference temperature Ts, and illustrates data of when environmental temperatures of the motor 3, that is, a temperature around the motor 3 and a temperature of the inside and the periphery of the image forming apparatus 1 are in a specific state during the experiment. However, since influence by the environmental temperatures is considered to be relatively small, in this example, difference in environmental temperature is not taken into consideration.

In FIG. 5, the correction information 70*a* is represented by a graph, but actually it is stored in the image forming apparatus 1 as a table or an arithmetic expression.

When the correction is based on the correction information 70*a*, the measured value corrector 212 corrects the measured value DIm as follows.

Referring to FIG. 3, the measured value corrector 212 is notified that the command of starting is given from the motor control command device 210 to the motor unit 30, and also of the target speed ω*. The measured value corrector 212 takes in the measured value DIm (y1) from the current measurer 211 at an appropriate timing y1 after the starting. This timing y1 is, for example, a timing when a certain time elapses from the starting and the rotation of the motor 3 reaches a constant speed and stabilizes.

Then, a difference between the measured value DIm (y1) taken in for the first time and a reference value (DIm0) stored in advance together with the correction information 70*a* is calculated as a current change amount Δy1 at the timing y1.

Next, in comparison with data corresponding to the notified target speed ω* in the correction information 70*a*, the elapsed time Y during the experiment corresponding to the calculated current change amount Δy1, that is, the initial timing y1 is identified.

In the example of FIG. 5, for example, when the target speed ω* is 2000/min, a point P1 on a curve L representing the relationship between the current change amount Δ and the elapsed time Y corresponds to the current change amount Δy1. In the elapsed time Y on the horizontal axis of the graph, the timing y1 corresponds to the point P1.

After that, the measured value corrector 212 corrects the measured value DIm to be measured next time and later, assuming that the current change amount Δ changes (in this example, increases) along the curve L from the point P1. The measured value corrector 212 therefore measures the elapsed time Y from the timing y1.

For example, when a measurement timing y2 of the next drive current Im is a timing when a time Y1 has elapsed from the initial timing y1, a point P2 is identified corresponding to the measurement timing y2 in the curve L, and a current change amount Δy2 is obtained corresponding to the point P2 in the current change amount Δ on the vertical axis. Then, the corrected measured value DAIm is calculated by using the following equation.

$$DAIm = DIm - \Delta y2$$

After that, it is only necessary to further perform measurement at the measurement timing after the next measurement timing and correct the measured value DIm similarly.

Unlike during the experiment, the initial starting described above means that the motor 3 has been started not in the reference temperature Ts but in a temperature state higher than the reference temperature Ts. This happens, for example, when a job is started again this time before the motor 3 is cooled in which temperature rise has occurred in the previous job.

That is, in a case where the motor 3 is started in an arbitrary temperature state, the initial measured value DIm (y1) described above is necessary to identify the timing y1 on the horizontal axis of the graph of FIG. 5 and determine a relationship between the temperature state of the motor 3 and the correction information 70*a* illustrated in FIG. 5.

In a case where the motor 3 is started at the same temperature state as that of when the correction information 70*a* illustrated in FIG. 5 is acquired, that is, at the same temperature as the reference temperature Ts, if the other conditions are the same, the initial measured value DIm (y1) of the first time is therefore equal to or close to the reference value (DIm0). That is, in this case, since the initial measurement timing y1 is at the position of Y=0 in the graph of FIG. 5, the initial measurement described above can be omitted. In this case, if the first measurement is performed at a timing when a time Y2 (for example, y1+Y1) has elapsed from the starting, the first measurement timing is the next measurement timing y2 described above. That is, the measurement at the measurement timing y2 corresponds to the first measurement in determination of step #502 in FIG. 12 to be described later.

Next, another example will be described of the method of correcting the measured value DIm.

Figure 6:
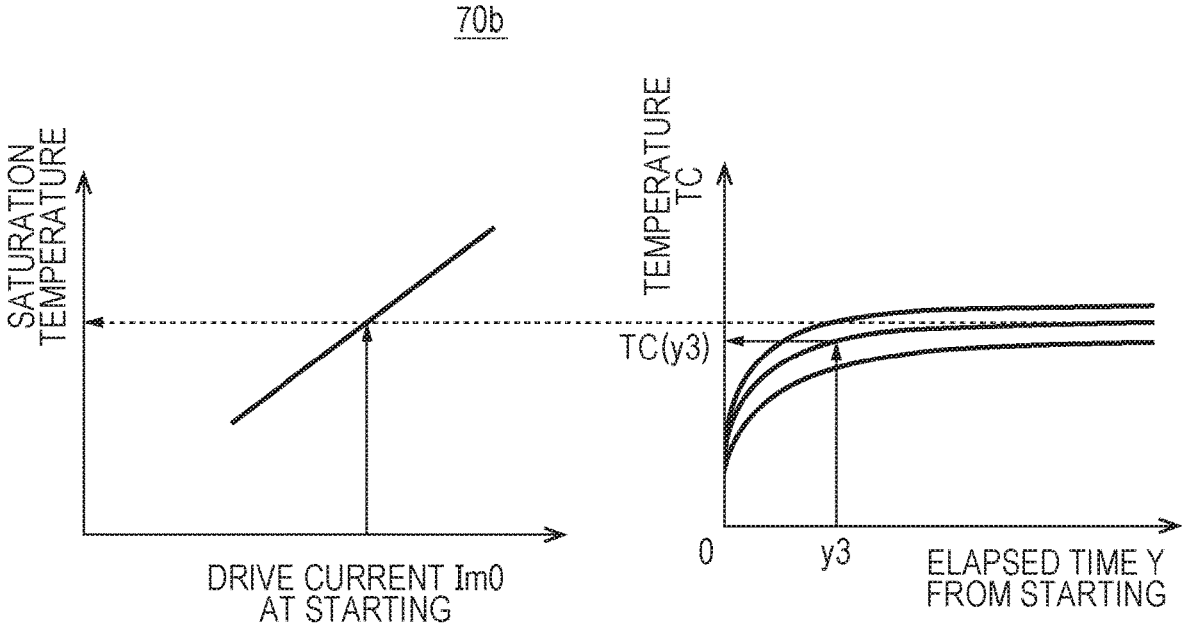
FIG. 6 is a diagram illustrating a procedure for identifying a temperature of the winding at a measurement timing on the basis of a drive current at starting.

FIG. 6 illustrates a procedure for identifying the temperature TC of the winding at a measurement timing y3 on the basis of a drive current Im0 at starting. To simplify the explanation, it is assumed here that the entire motor 3 starts rotating from a temperature state in which the temperature is the reference temperature Ts.

As described above, temperature rise of the winding of the motor 3 occurs due to current supply, but the temperature eventually settles to a substantially constant temperature (saturation temperature). As illustrated in the graph on the right side of FIG. 6 stored as part of correction information 70*b*, this saturation temperature has variations due to the individual differences of the motor 3 or the load. However, as illustrated in the graph on the left side of FIG. 6 also stored as part of the correction information 70*b*, the saturation temperature is substantially proportional to the drive current Im0 at the starting.

The drive current Im0 is therefore measured at the starting and the saturation temperature of the motor 3 is identified. That is, a temperature rise characteristic of the winding of the motor 3 is identified. Thereafter, at the arbitrary measurement timing y3 during rotation, the temperature TC (y3) of a present winding is identified in comparison with the identified temperature rise characteristic.

Then, a change rate β is calculated of the resistance value R between the reference temperature Ts and the present temperature TC (y3) on the basis of a relationship between the temperature TC and the resistance value R in the winding illustrated in FIG. 4A. The change rate β is expressed by the following equation.

$$\beta = (\text{resistance value } R \text{ at present temperature } TC(y3))/(\text{resistance value } Rs \text{ at reference temperature } Ts)$$

In the case of this example, the measured value corrector 212 calculates the corrected measured value DAIm by using the following equation.

$$DAIm=DIm\times\beta$$

Further, there is also a method of using a feedback signal or another signal in the vector control for the correction of the measured value DIm as follows.

Figure 7:
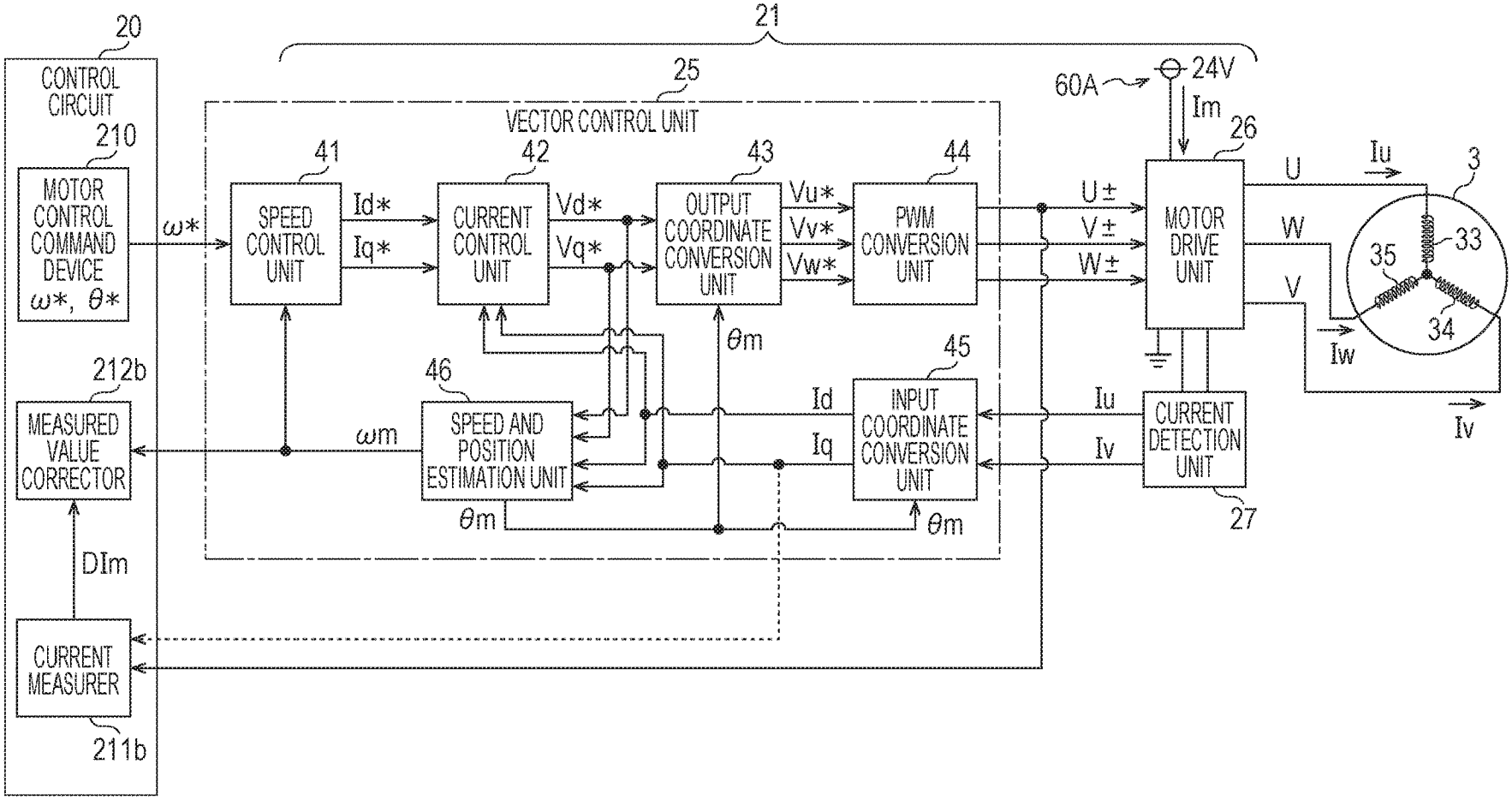
FIG. 7 is a diagram illustrating a functional configuration of a motor controller.

FIG. 7 illustrates a functional configuration of a motor controller 21, and FIG. 8 illustrates another example of the correction information 70.

The motor 3 is driven by the motor controller 21 and is subjected to sensorless vector control. In this vector control, proportional-integral-derivative control (PID control) is performed that causes a rotational speed (ωm) of the motor 3 to coincide with the target speed ω* by feedback.

The motor controller 21 includes a motor drive unit 26 that supplies power to the motor 3, a current detection unit 27 that detects a current flowing through the motor 3, and a vector control unit 25 that indirectly controls the rotation of the motor 3 by controlling the motor drive unit 26.

The motor drive unit 26 is an inverter circuit for driving a rotor by causing currents to flow through the windings 33 to 35 of the motor 3. The motor drive unit 26 controls the drive current Im flowing from a DC power supply line 60A to a ground line via the windings 33 to 35 by turning on and off a plurality of transistors in accordance with control signals U+, U−, V+, V−, W+, and W− from the vector control unit 25. Specifically, a current Iu flowing through the winding 33 is controlled in accordance with the control signals U+ and U−, a current Iv flowing through the winding 34 is controlled in accordance with the control signals V+ and V−, and a current Iw flowing through the winding 35 is controlled in accordance with the control signals W+ and W−.

The current detection unit 27 detects the currents Iu and Iv respectively flowing through the windings 33 and 34. Since Iu+Iv+Iw=0, the current Iw can be calculated from values of the detected currents Iu and Iv. Note that, a W-phase current detection unit may be provided.

The current detection unit 27 performs A/D conversion of a signal obtained by a voltage drop due to a shunt resistor inserted in a flow path of the currents Iu and Iv, and outputs converted signals as detected values of the currents Iu and Iv. That is, two-shunt type detection is performed. A resistance value of the shunt resistor is a small value of the order of 1/10Ω.

The vector control unit 25 includes a speed control unit 41, a current control unit 42, an output coordinate conversion unit 43, a PWM conversion unit 44, an input coordinate conversion unit 45, and a speed and position estimation unit 46. The target speed (speed command value) ω* is given to the vector control unit 25 from the control circuit 20 by the control signal S3.

The speed control unit 41 performs calculation for proportional-integral control (PI control) that brings a difference between the target speed ω* from the control circuit 20 and an estimated speed (rotational speed) ωm from the speed and position estimation unit 46 close to zero, and determines current command values Id* and Iq* of the d-q coordinate system. The estimated speed mm is periodically input. The speed control unit 41 determines the current command values Id* and Iq* each time the estimated speed ωm is input.

The current control unit 42 performs calculation for proportional-integral control that brings a difference between the current command value Id* and an estimated current value (d-axis current value) Id from the input coordinate conversion unit 45, and a difference between the current command value Iq* and an estimated current value (q-axis current value) Iq also from the input coordinate conversion unit 45 close to zero. Then, voltage command values Vd* and Vq* in the d-q coordinate system are determined.

On the basis of an estimated angle ωm from the speed and position estimation unit 46, the output coordinate conversion unit 43 converts the voltage command values Vd* and Vq* into U-phase, V-phase, and W-phase voltage command values Vu*, Vv*, and Vw*. That is, conversion is performed of the voltage from two phases to three phases.

On the basis of the voltage command values Vu*, Vv*, and Vw*, the PWM conversion unit 44 generates patterns of control signals U+, U−, V+, V−, W+, and W− depending on the amplitude of a pseudo sinusoidal voltage to be applied to the windings 33 to 35, and outputs the patterns to the motor drive unit 26. The control signals U+, U−, V+, V−, W+, and W− are signals for controlling the frequency and amplitude of three-phase AC power to be supplied to the motor 3 by pulse width modulation (PWM).

The input coordinate conversion unit 45 calculates a value of the W-phase current Iw from values of the U-phase current Iu and the V-phase current Iv detected by the current detection unit 27. Then, on the basis of the estimated angle θm from the speed and position estimation unit 46 and the values of the three-phase currents Iu, Iv, and Iw, the d-axis current value Id and the q-axis current value Iq is calculated that are estimated current values of the d-q coordinate system. That is, conversion is performed of the current from three phases to two phases. The q-axis current value Iq is an example of the measured value of the motor current flowing through the windings 33 to of the motor 3 to generate torque of rotation.

On the basis of the estimated current values (Id, Iq) from the input coordinate conversion unit 45 and the voltage command values Vd* and Vq* from the current control unit 42, the speed and position estimation unit 46 obtains the estimated speed value ωm and the estimated angle θm in accordance with a so-called voltage current equation. The obtained estimated speed value ωm is input to the speed control unit 41. The obtained estimated angle θm is input to the output coordinate conversion unit 43 and the input coordinate conversion unit 45.

The control signals U+, U−, V+, V−, W+, and W− output from the vector control unit 25 can be measured as the drive current Im. For example, the control signals U+ and U− are input to the current measurer 211*b* of the control circuit 20.

The current measurer 211*b* obtains a voltage to be applied to the motor 3 from the pattern of one period of the PWM modulation of the control signals U+ and U−. Then, from the voltage and the known resistance value Rs at the reference temperature Ts of the winding through which the current Iu flows when the voltage is applied, a value of the current Iu is obtained and output as the measured value DIm of the drive current Im.

The measured value corrector 212*b* of the control circuit 20 acquires, for example, the estimated speed value ωm from the vector control unit 25, and corrects the measured value DIm of the drive current Im depending on a deviation amount Δω between the estimated speed value tom and the target speed ω* in accordance with the correction information 70*b* illustrated in FIG. 8.

In this example, it is assumed that the load of the motor 3 is constant, and speed change in a constant speed control period is caused by the characteristic change accompanying the temperature rise of the motor 3.

In FIG. 8, correction information 70*c* is a table in which the positive deviation amount Δω in which the estimated speed value ωm is greater than the target speed ω*, and the negative deviation amount Δω in which the estimated speed value ωm is less than the target speed ω* each are associated with a corresponding current correction amount ΔIm. However, the information may be an arithmetic expression for calculating the current correction amount ΔIm on the basis of the deviation amount Δω.

In the case of this example, the measured value corrector 212*b* calculates the corrected measured value DAIm by using the following equation.

$$DAIm=DIm+\Delta Im$$

For example, when the deviation amount Δω is "−2", since the current correction amount ΔIm is "−0.02", the corrected measured value DAIm becomes "DIm−0.02" and is a value smaller than the measured value DIm before correction.

Figure 9A:
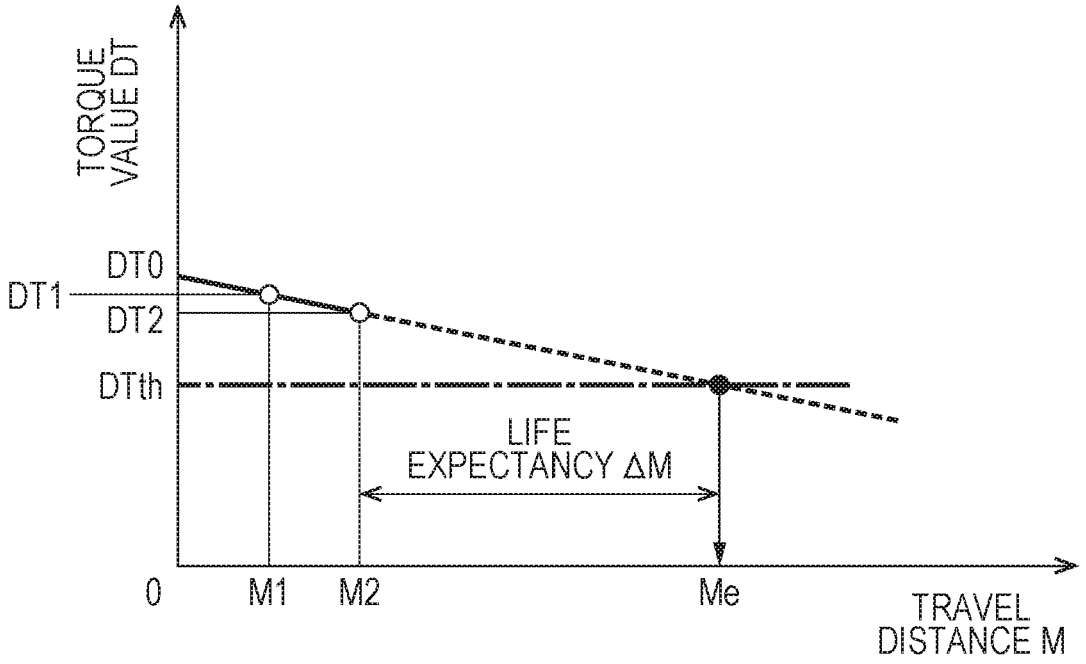
FIGS. 9A and 9B are diagrams illustrating an example of determination of a state of a rotating body.
Figure 9B:
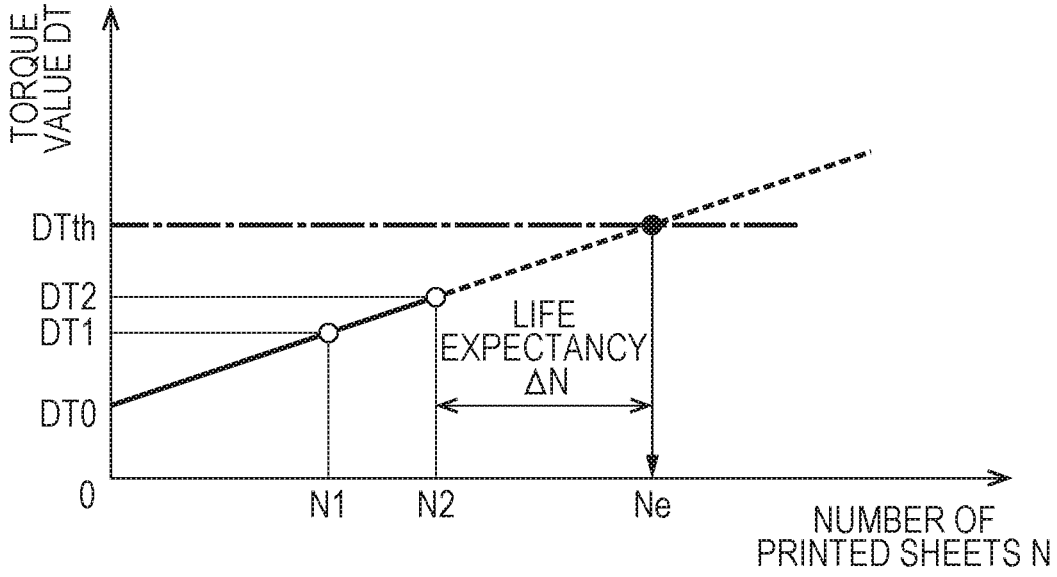

FIGS. 9A and 9B illustrate an example of determination of the state of the rotating body. In the example of FIG. 9A, a degradation state of the roller for conveying the sheet 2 is quantified as life expectancy (remaining lifetime) ΔM until the lifetime of the roller is exhausted. In the example of FIG. 9B, a degradation state of the rotating body with which the blade for cleaning is brought into contact, such as the photoconductor 5 or the intermediate transfer belt 15, is quantified as life expectancy ΔN until the lifetime of the rotating body is exhausted.

Regarding FIG. 9A, for example, circumferential surfaces of the sheet ejection rollers 18A and 18B are worn by use. For this reason, the surfaces become slippery, and conveying force with respect to the sheet 2 gradually decreases. The life expectancy ΔM can be used as a criterion for determining necessity of replacement of the sheet ejection rollers 18A and 18B.

When the sheet ejection rollers 18A and 18B become slippery, the load is reduced with respect to the motor 3*c*, so that control for reducing the torque is performed for the motor 3*c*. That is, the torque of the motor 3*c* changes in accordance with the degree of wear of the roller. The state of the roller can therefore be determined from the measured value of the torque.

In FIG. 9A, the torque value DT is DT1 when a travel distance (cumulative conveying distance) M of the roller is M1, and the torque value DT is DT2 when the travel distance M is M2. Note that, an index for determining the measurement timing for acquiring the torque value DT is not limited to the travel distance M. For example, the index may be the number of printed sheets (cumulative number of times of printing) N.

On the basis of the torque values DT1 and DT2, a change rate is obtained of the torque value DT in a period from the measurement timing when the travel distance M is M1 to the measurement timing when the travel distance M is M2. The change rate is expressed by (DT2−DT1)/(M2−M1).

Assuming that the torque value DT changes (in this case, decreases) at the obtained change rate thereafter, a travel distance Me is calculated at a timing at which the torque value DT will be a predetermined threshold value DTth. Then, a difference between Me and M2 is calculated as the life expectancy ΔM.

Predetermined processing can be performed depending on the life expectancy ΔM, and for example, a message is displayed recommending replacement of the roller when the life expectancy ΔM is less than a set value.

Regarding FIG. 9B, for example, an edge of a blade made of an elastic member provided on the cleaner 9 is brought into contact with the photoconductor 5 in a counter direction opposite to the rotation of the photoconductor 5. Frictional force between the photoconductor 5 and the blade gradually increases due to degradation of the circumferential surface of the photoconductor 5 or wear of the blade. When the frictional force becomes excessive, the edge of the blade is dragged by the photoconductor 5 and is folded back into a so-called curling state. If the blade curls, not only it becomes impossible to clean, but also the rotation of the photoconductor 5 becomes defective, and in some cases the photoconductor 5 may be damaged.

When the frictional force between the photoconductor 5 and the blade increases, the load is increased with respect to the motor 3*a*, so that control for increasing the torque is performed for the motor 3*a*. That is, the torque of the motor 3*a* changes depending on the frictional force with the blade. The contact state of the photoconductor 5 with the blade can therefore be determined from the measured value of the torque. This also applies to the intermediate transfer belt 15.

In FIG. 9B, the torque value DT is DT1 when the number of printed sheets N from the start of using the photoconductor 5 is N1, and the torque value DT is DT2 when the number of printed sheets N is N2. Note that, the index for determining the measurement timing for acquiring the torque value DT may be the travel distance M of the photoconductor 5.

On the basis of the torque values DT1 and DT2, a change rate is obtained of the torque value DT in a period from the measurement timing when the number of printed sheets N is N1 to the measurement timing when the number of printed sheets N is N2. This change rate is expressed by (DT2−DT1)/(N2−N1).

Assuming that the torque value DT changes (in this case, increases) at the obtained change rate thereafter, the number of printed sheets Ne is calculated at a timing at which the torque value DT will be a predetermined threshold value DTth. Then, a difference between Ne and N2 is calculated as the life expectancy ΔN.

Predetermined processing can be performed depending on the life expectancy ΔN, and for example, a message is displayed recommending replacement of the photoconductor 5 and the blade when the life expectancy ΔN is less than a set value.

Figure 10:
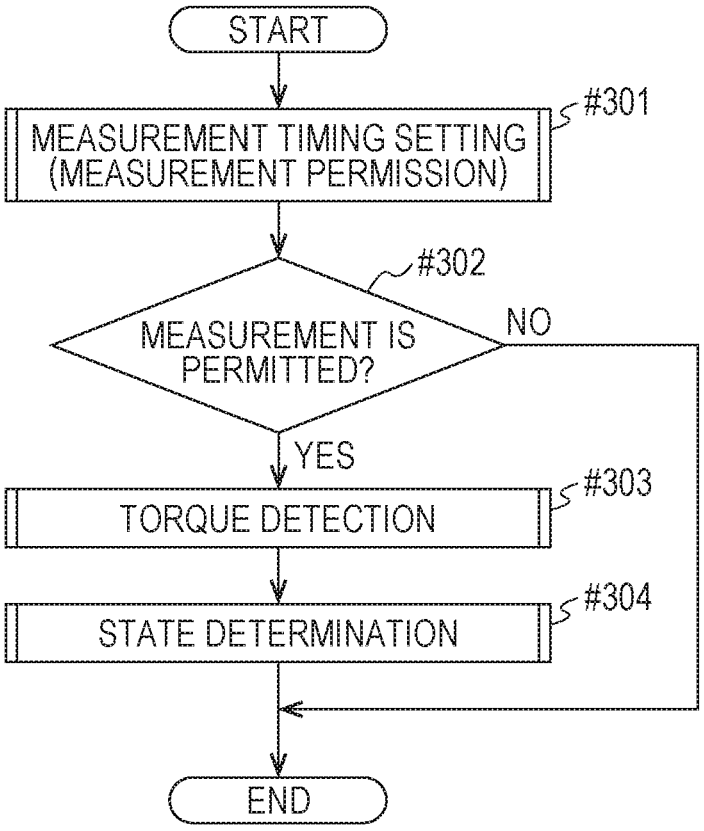
FIG. 10 is a diagram illustrating a flow of processing related to the determination of the state of the rotating body in the image forming apparatus.
Figure 11:
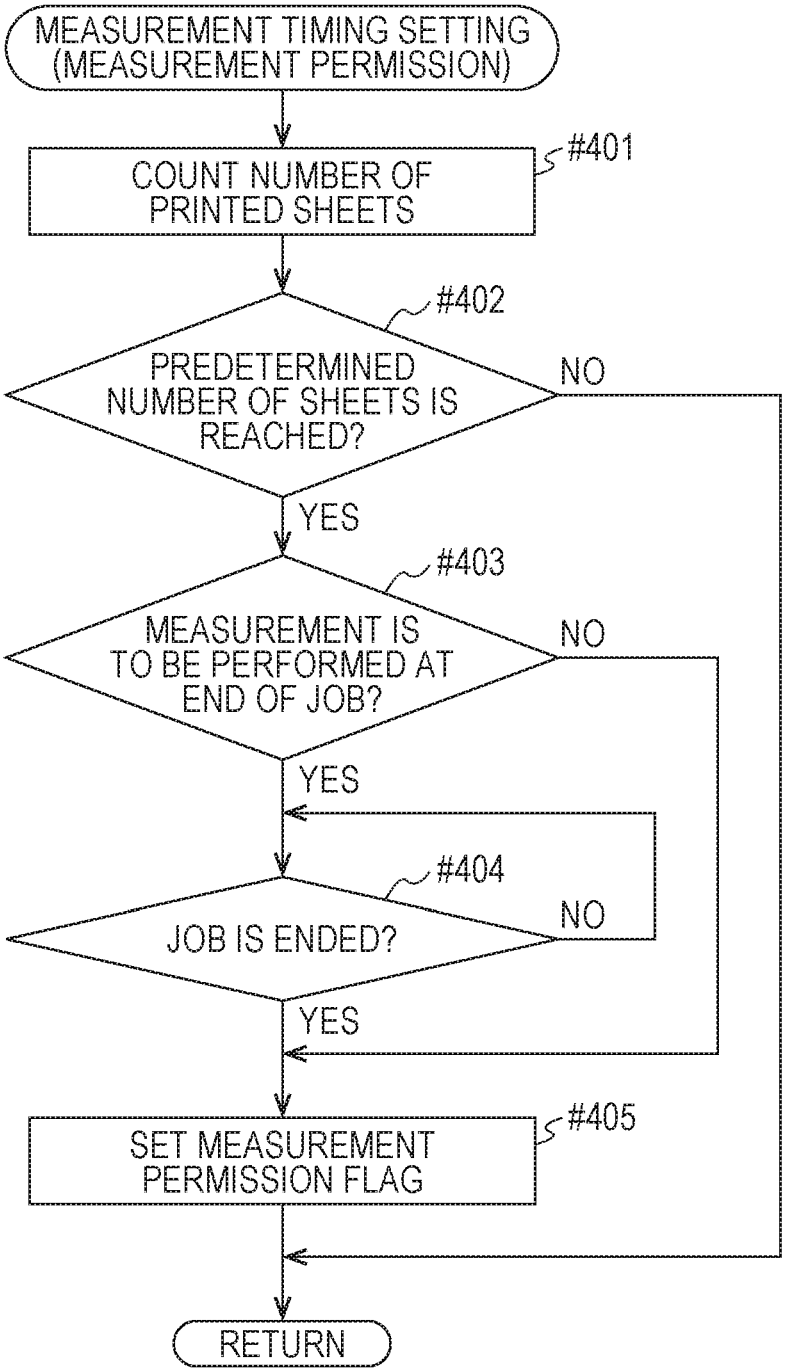
FIG. 11 is a diagram illustrating an example of a flow of measurement timing setting processing.
Figure 12:
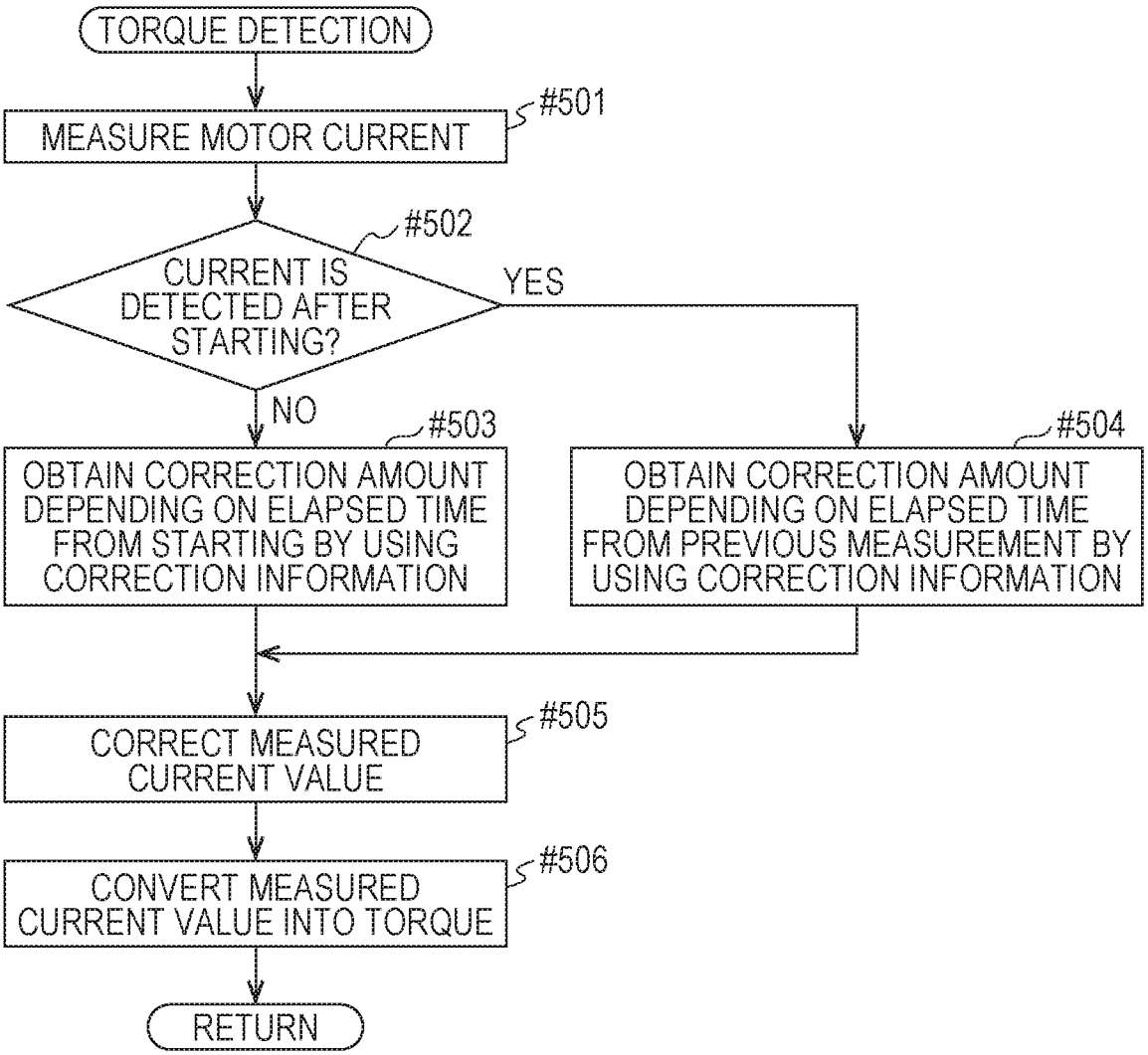
FIG. 12 is a diagram illustrating a flow of torque detection processing.
Figure 13:
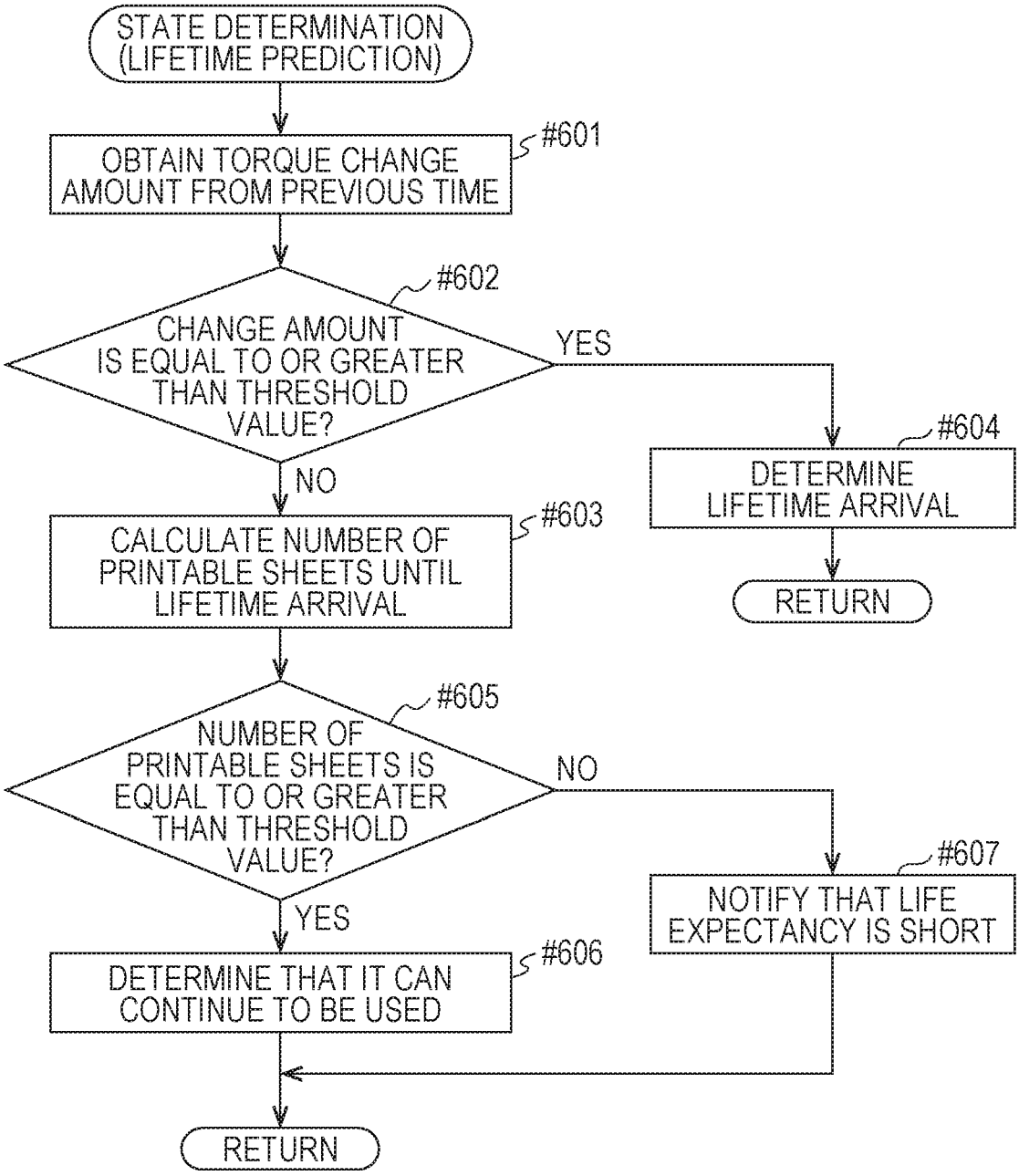
FIG. 13 is a diagram illustrating a flow of state determination processing.

FIG. 10 illustrates a flow of processing related to the determination of the state of the rotating body in the image forming apparatus 1, FIG. 11 illustrates an example of a flow of measurement timing setting processing, FIG. 12 illustrates a flow of torque detection processing, and FIG. 13 illustrates a flow of state determination processing.

As illustrated in FIG. 10, when a predetermined condition is satisfied, measurement timing setting is performed for permitting measurement of the motor current (#301). It is checked whether or not the measurement is permitted by the measurement timing setting (#302), and when it is permitted (YES in #302), the torque detection processing (#303) and the state determination processing (#304) are executed in order.

In the example of FIG. 11, it is assumed that a condition is defined that the state of the rotating body is determined each time printing is performed of a predetermined number of sheets.

Each time printing is performed, a count value is updated of the number of printed sheets N after the previous measurement (#401). When the updated number of printed sheets N is checked (#402), and the number of printed sheets N reaches a predetermined number of sheets n (YES in #402), it is checked whether or not it is defined that the measurement is to be performed for a rotating body to be subjected to state determination at the end of a job (#403).

When it is not defined that the measurement is to be performed at the end of the job (NO in #403), a measurement permission flag is set as processing to permit the measurement (#405). When it is defined that the measurement is to be performed at the end of the job (YES in #403), waiting is performed for the end of the job (#404), and the measurement permission flag is set (#405).

The predetermined number of sheets n is selected depending on the rotating body to be subjected to the state determination and a purpose of the state determination. For example, when the state determination is performed for the purpose of predicting the lifetime of the sheet ejection rollers 18A and 18B, the predetermined number of sheets n can be set to 5000 to 10000, for example. In continuous printing exceeding several hundred sheets, when the state determination is performed as an operation check during job execution, the predetermined number of sheets n may be set to 100, for example.

In the torque detection processing as illustrated in FIG. 12, the motor current is measured (#501), and it is checked whether or not the measurement is the first measurement after starting of the motor 3 (#502). When it is the first measurement after the starting (YES in #502), a correction amount depending on an elapsed time from the starting is obtained by using the correction information 70, and the measured value DIm is corrected (#503, #506). When it is not the first measurement after the starting (NO in #502), a correction amount depending on an elapsed time from the previous measurement is obtained, and the measured value DIm is corrected (#504, #506). Then, the corrected measured value ADIm is converted, and the torque value DT is obtained.

In the state determination processing as illustrated in FIG. 13, a change amount is obtained of the torque value DT from the previous time (#601), and it is determined whether or not the change amount is equal to or greater than a threshold value (#602).

When the change amount of the torque value DT is equal to or greater than the threshold value (YES in #602), it is determined that the lifetime of the rotating body is exhausted (lifetime arrival) (#604). In this case, the subsequent image formation may be prohibited.

When the change amount of the torque value DT is less than the threshold value (NO in #602), the number of printable sheets until the lifetime arrival, that is, the life expectancy is calculated (#603). When the calculated life expectancy is equal to or greater than a set value (YES in #605), it is determined that the rotating body can continue to be used (#606). When the life expectancy is less than the set value (NO in #605), a user or a service person is notified that the life expectancy is short (#607).

According to the above embodiment, the measured value DIm of the motor current measured as the torque of the motor 3 is corrected to cancel the current change amount based on the characteristic change depending on the temperature state of the motor 3, so that the state of the rotating body can be determined with higher accuracy than before on the basis of the corrected measured value. In addition, there is no need to use a torque sensor.

In the above-described embodiment, an actual rotational speed ω of the motor 3 may be detected by a speed detector such as an encoder or a resolver. In this case, the measured value corrector 212 obtains the current change amount based on the characteristic change depending on the temperature state of the motor 3, depending on a difference between the rotational speed ω of the motor 3 at the measurement timing and the target speed ω*, and performs correction by using the current change amount.

In the above-described embodiment, an example has been described in which the measured value DIm is corrected in accordance with the deviation amount Δω between the target speed ω* and the estimated speed value ωm or the actual rotational speed ω, and it can be performed as follows.

That is, a rotational angle position θ of the motor 3 is detected or measured by a rotational angle position detector such as a Hall element or an encoder. Then, the measured value DIm is corrected depending on a deviation amount Δθ between the rotational angle position θ and a position command θ*. That is, in this case, the measured value corrector 212 obtains the current change amount based on the characteristic change of the motor 3 depending on a difference between an actual measured value (rotational angle position θ) of the rotational position of the motor 3 at the measurement timing and a target position (position command θ*), and performs correction by using the current change amount. In the correction of this case, it is only necessary to store correction information 70*d* illustrated in FIG. 14, for example. The correction information 70*d* is a table or an arithmetic expression indicating the current correction amount ΔIm depending on the deviation amount Δθ. Note that, the target position of this case, that is, the position command θ* can be generated, for example, by integrating the target speed ω* in the motor control command device 210 or the speed control unit 41.

The measured value DIm may be corrected depending on a difference between the target position (position command θ*) and a measured value of the rotational position of the motor 3 detected or measured by a method different from the above-described method or an estimated value.

In this case, the motor 3 only needs to be subjected to the vector control in the vector control unit 25 similarly as described above.

In the above-described embodiment, the correction information 70*a* illustrated in FIG. 5 is provided for each of a plurality of temperature ranges that divide an assumed environmental temperature range, and the current change amount Δ at the measurement timing may be identified by using the correction information 70*a* corresponding to an actual environmental temperature of the image forming apparatus 1. That is, the environmental temperature is detected by a sensor, and the measured value DIm is corrected in consideration of a difference between the reference temperature Ts and the environmental temperature. Thus, the measured value DIm can be corrected more accurately.

The motor 3 incorporates a temperature sensor for detecting a motor temperature that is a temperature inside the motor 3, and the measured value DIm of the motor current may be corrected depending on the detected motor temperature on the basis of the correction information 70 indicating a relationship between the motor temperature and the current change amount.

When the motor current is measured at the end of a job, on the basis of the number of sheets of image formation of the job, a difference between the reference temperature Ts and the motor temperature is estimated and the current change amount Δ is identified, and the measured value DIm may be corrected.

In the above-described embodiment, when a circuit component for the vector control capable of taking out the q-axis current value Iq is mounted unlike the electric circuit 31 of the motor unit 30, the q-axis current value Iq or q-axis current command value Iq* may be used as the measured value DIm of the motor current indicating the torque of the motor 3. In that case, it is preferable to correct the measured value DIm in consideration of a possibility that a change amount due to the temperature rise of the motor 3 is included in the q-axis current value Iq.

In the above-described embodiment, the vector control is not limited to the sensorless vector control. It may be vector control that causes the rotational speed ω measured by using a sensor such as a Hall element, an encoder, or a resolver to coincide with the target speed ω*.

Besides, the configuration of the whole or each part of the image forming apparatus 1, the details, order, or timing of the processing, the configuration of the motor 3, the configuration of the motor controller 21, and the like can be appropriately changed in accordance with the spirit of the present invention.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming apparatus that forms an image on a sheet, the apparatus comprising:

a rotating body that forms the image;

a motor that rotationally drives the rotating body;

a current measurer that measures a motor current flowing through a current supply path including a winding of the motor at a measurement timing that is a timing after the motor is started;

a torque acquisitor that acquires a torque value of the motor, based on a measured value of the motor current;

a corrector that performs correction to cancel a current change amount based on a characteristic change depending on a temperature state of the motor at the measurement timing, in acquisition of the torque value by the torque acquisitor; and a motor controller that performs vector control to rotate the motor at a target speed, wherein the corrector obtains the current change amount based on a difference between a measured value or an estimated value of a rotational speed of the motor at the measurement timing, and the target speed, and performs correction using the current change amount.

2. The image forming apparatus according to claim 1, wherein the corrector performs correction depending on an elapsed time from starting of the motor to the measurement timing, based on information indicating a relationship between a motor operation time and the current change amount.

3. The image forming apparatus according to claim 2, wherein:

the corrector stores in advance, as the information, correction information indicating a relationship between an elapsed time from starting when the motor is started in a specific temperature state, and the current change amount, and the corrector performs correction, based on the elapsed time and the measured value of the motor current measured at the measurement timing.

4. The image forming apparatus according to claim 1, wherein:

the corrector identifies a temperature characteristic of the winding of the motor, based on a measured value of the motor current when the motor is started, identifies a temperature of the winding at the measurement timing from the temperature characteristic, and obtains as the current change amount a change rate of a resistance value from starting to the measurement timing by using information indicating a relationship between the temperature of the winding and the resistance value, and the corrector performs correction using the change rate.

5. The image forming apparatus according to claim 1, wherein:

the motor includes a temperature sensor that detects a motor temperature, and the corrector performs correction depending on the motor temperature, based on information indicating a relationship between the motor temperature and the current change amount.

6. The image forming apparatus according to claim 1, further comprising a determiner that determines a state of the rotating body, based on the torque value acquired.

7. The image forming apparatus according to claim 6, wherein:

the rotating body is a roller that conveys the sheet, and the determiner determines a wear state of a circumferential surface of the rotating body.

8. The image forming apparatus according to claim 6, wherein:

the rotating body is a member that rotates in a state in which a blade that cleans a circumferential surface of the rotating body is in contact with the rotating body, and the determiner determines a sliding state between the rotating body and the blade.

9. The image forming apparatus according to claim 6, wherein the determiner determines or predicts a lifetime of the rotating body.

10. An image forming apparatus comprising:

a rotating body that forms the image;

a motor that rotationally drives the rotating body;

a current measurer that measures a motor current flowing through a current supply path including a winding of the motor at a measurement timing that is a timing after the motor is started;

a torque acquisitor that acquires a torque value of the motor, based on a measured value of the motor current;

a corrector that performs correction to cancel a current change amount based on a characteristic change depending on a temperature state of the motor at the measurement timing, in acquisition of the torque value by the torque acquisitor; and a motor controller that performs vector control to bring a rotational position of the motor to a target position, wherein the corrector obtains the current change amount based on a difference between a measured value or an estimated value of the rotational position of the motor at the measurement timing, and the target position, and performs correction using the current change amount.

* * * * *